United States Patent [19]

Pasour et al.

[11] 4,194,139

[45] Mar. 18, 1980

[54] REFLEX TETRODE FOR PRODUCING AN EFFICIENT UNIDIRECTIONAL ION BEAM

[75] Inventors: John A. Pasour, Alexandria, Va.; Christos A. Kapetanakos, Bethesda, Md.; Redge A. Mahaffey, Wheaton, Md.; Jeffry Golden, Laurel, Md.

[73] Assignee: The United States of America as represented by the Secretary of the Navy, Washington, D.C.

[21] Appl. No.: 936,146

[22] Filed: Aug. 23, 1978

[51] Int. Cl.[2] ..... H01J 23/08; H01J 27/00; H05H 1/00

[52] U.S. Cl. ..... 313/153; 250/423 R; 313/230; 313/359

[58] Field of Search ..... 313/231.3, 230, 359, 313/153; 315/111.8, 111.9; 250/423 R

[56] References Cited

U.S. PATENT DOCUMENTS

| | | | |
|---|---|---|---|
| 3,793,550 | 2/1974 | Thompson, Jr. | 313/360 |
| 3,989,975 | 11/1976 | Trotel | 313/231.3 |
| 4,045,677 | 8/1977 | Humphries, Jr. et al. | 250/423 R |
| 4,080,549 | 3/1978 | Creedon et al. | 313/231.3 X |
| 4,126,806 | 11/1978 | Kapetanakos et al. | 313/230 X |

*Primary Examiner*—Palmer C. Demeo
*Attorney, Agent, or Firm*—R. S. Sciascia; Philip Schneider; Melvin L. Crane

[57] ABSTRACT

A reflex tetrode device for efficiently generating intense, pulsed unidirectional ion beams. The device includes two thin, semitransparent anodes spaced from a real cathode which is maintained at ground potential. The first anode is spaced from and faces the real cathode. The second anode is spaced a short distance from the first anode and a virtual cathode is formed beyond the second anode when a sufficiently high electron current flows from the real cathode and through the anodes. The anodes are ring-like or disc-like structures secured to the edges of a support member with their planes perpendicular to the axis of the device between the real and virtual cathodes. The anode structure (i.e., the support member together with the two anodes) is connected to a pulsed high-voltage generator which is operated in positive polarity. Consequently, both anodes are at the same positive potential. The first anode, because of its material, does not readily form an ionic plasma when electrons pass through it, but the second anode does.

15 Claims, 6 Drawing Figures

REFLEX TETRODE FOR PRODUCING AN EFFICIENT UNIDIRECTIONAL ION BEAM

BACKGROUND OF THE INVENTION

This invention relates to devices for generating intense ion beams and more particularly to a device for efficiently generating an intense unidirectional ion beam.

Heretofore different types of devices have been used to produce intense, pulsed ion beams. These devices fall primarily in three different categories: pinched beam diodes, magnetically insulated diodes, and reflex triodes. Pinched beam diodes are efficient but cannot be operated in an external magnetic field. In magnetically insulated diodes, the ions are accelerated perpendicularly to an external magnetic field which must exceed the value required to suppress the electron flow. These ion sources are characterized by high efficiences but low ion-current density.

Reflex triodes can be used in an external axial magnetic field, and they have been used to produce beams with high ion-current densities. They can produce solid or annular beams of various cross sections. However, the ion flow in reflex triode is bidirectional i.e., approximately the same number of ions flow back toward the real cathode (and hence cannot be used) as flow forward toward the virtual cathode. Partly because of the backward-flowing ions, which enhance emission of electrons from the real cathode, the triode suffers from an abrupt decrease in impedance. The bidirectionality of thee beam and the impedance-collapse problem limit the efficiency of the reflex triode to a relatively low value.

The reflex tetrode has all the advantages of the reflex triode. Furthermore, the unidirectionality of the ion beam and the significant decrease in impedance collapse allow the reflex tetrode's efficiency to be much larger than that of the reflex triode.

SUMMARY OF THE INVENTION

In carrying out this invention, a pair of spaced anodes are placed in front of a cathode. The anodes are connected to a pulsed high-voltage generator operated in positive polarity. The first anode (the anode closer to the real cathode) is made of a material that does not readily produce a plasma. The second anode(the anode facing the virtual cathode) is made of a material that does readily break down to produce a plasma when a high-voltage pulse is applied to the device and electrons pass back-and-forth through the second anode. The electric potential of the reflex tetrode is such that the ions from the second anode plasma cannot pass the first anode and therefore are propagated only toward the virtual cathode. Since the first anode is a poor source of ions, nearly all(more than 95%) of the ion current, flows toward the virtual cathode. A magnetic field with the field parallel to the direction of the ions guides the ions to their desired place for use. Such positive ions may be used for exciting lasers and plasma heating.

Advantages are: unidirectional ion flow, high efficiency, reduction in impedance collapse, the ability to operate over a wide range of axial magnetic field, a relatively high ion-current density and an ability to generate annular or solid beams of a wide range of cross-sectional shapes and sizes.

DETAILED DESCRIPTION

Figure 1:
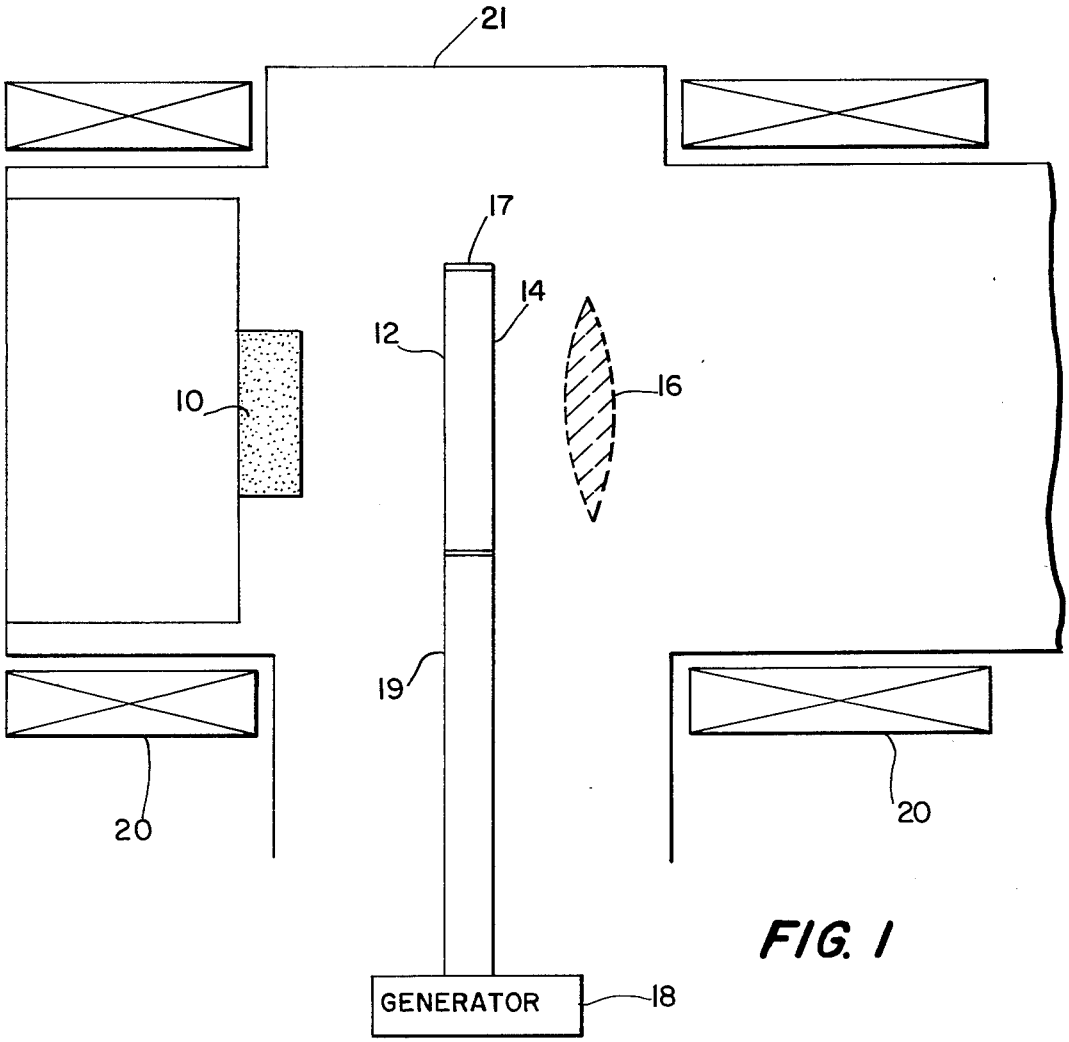
FIG. 1 is a schematic of an embodiment of a side-fed, reflex tetrode system.

FIG. 1 is a schematic diagram which illustrates the relative parts of a reflex tetrode system. As shown, the system includes a real cathode 10 made of graphite or any other suitable material. Located a short distance from the real cathode10 is an anode structure including first and second anodes 12 and 14 of thin disc-like films separated from each other by a small distance. The first anode 12 is closer to the real cathode and is made of materials which do not readily break down to produce an appreciable amount of plasma, such as polycarbonate (KIMFOL) or aluminized mylar film (thin sheet), Kapton or titanium foil. The second anode 14 parallels the first anode and is on the side thereof away from the real cathode and facing a virtual cathode 16. The second anode is made of a polyethylene film or other material which readily breaks down to produce plasma. Each of the films is stretched tightly and secured to one edge of a rigid ring 17 whose axial length (from left to right in FIG. 1) is chosen to be the desired anode separation. Each of the anodes is maintained at the same positive potential being connected to a pulsed high-voltage generator 18 by use of an anode stalk 19. The particular configuration shown in FIG. 1 is a "side-fed" reflex tetrode, in which the anode stalk 19 that is connected to the high-voltage generator is oriented perpendicularly to the cathode-anode axis. The ring 17 and attached anodes are positioned with their centers on the axis of the reflex tetrode with the planes of the anode foils perpendicular to the axis. The anodes are also perpendicular to the direction in which the protons ae accelerated,viz.,the cathode-to-anode direction. The double anode structure and cathode are secured within a chamber 21 which can be evacuated to a desired pressure. A magnetic field is applied by magnets 20 such that the field is in the direction of the axis between the cathode and anode structure.

In assembly of an exemplary system for producing a positive voltage pulse of 500 KV and 50 ns duration, the following dimensions, etc., may be used. The real cathode is made of graphite, and is from about 2 cm to about 10 cm in diameter with a thickness of about 2.5 cm and is at ground potential. The first anode is spaced from about 0.6 cm to about 2.5 cm from the real cathode and is made of an aluminized mylar film having a thickness of from about 6 $\mu$m to about 20 $\mu$m or a polycarbonate (KIMFOL)sheet having a thickness of from about 2 $\mu$m to about 4 $\mu$m. The second anode is spaced from about 0.2 cm to about 1.1 cm from the first anode and is made of polyethylene sheet having a thickness of from about 6 $\mu$m to about 100 $\mu$m. The first and second anodes are at the same potential. The ring upon which the anodes are mounted is made of aluminum with a 12.7 cm inside diameter and connected to the output of a Seven-Ohms Line (SOL) high-voltage generator or any other suitable high-voltage generator which is operated in positive polarity. The peak output voltage pulse of the SOL generator is about 500 KV with a duration of 50 nsec. The magnetic field is from about 2.7 KG to about 7.6 KG and the housing containing the cathode and anode structures is evacuated to a vacuum pressure of from about 0.1 to about 0.9 milli Torr.

In operation of the above exemplary system, a pulse from the SOL generator is applied to the anodes. Electrons are emitted from the cathode and accelerate to, and penetrate the anodes to form a virtual cathode 16 at the downstream side of the second anode. As the electrons reflex between the virtual and real cathode, plasma is formed on the second anode by the oscillating electrons. Ions (primarily protons in this system) are extracted out of the plasma and are accelerated toward the virtual cathode and the real cathode. The protons accelerated toward the real cathode cannot pass the first anode because the positive electric potential at the first anode acts as a barrier to ions emitted from the second anode. Ions from the second anode reach the first anode with zero velocity, so ion flow in the area between the real cathode and the first anode is suppressed. As a result, the ion beam propagates only in the direction of the virtual cathode. As the protons exit the virtual cathode and form a drifting beam, electrons are dragged along. Thus, the ion beam is space charge and current-neutralized and is unidirectional, that is, traveling away from the anode structure in one direction.

Figure 2:
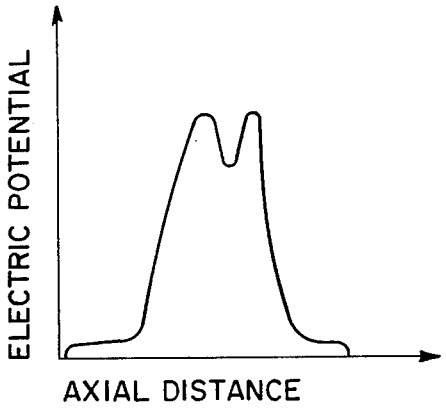
FIG. 2 illustrates the potential distribution inside the device shown in FIG. 1.

FIG. 2 illustrates the electric potential distribution of the reflex tetrode. As a result of using a double anode structure, an electric potential profile is obtained by which ions from the anode plasma are accelerated only in the forward direction, that is toward the virtual cathode. It has been determined that about 95% of the protons are accelerated in the forward direction.

Figure 3A:
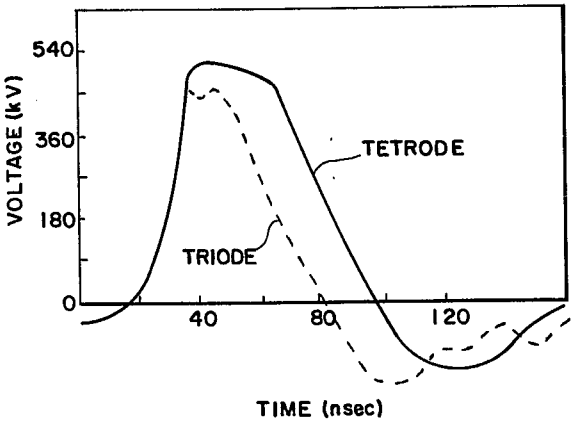
FIG. 3*a* and 3*b* show voltage and current waveforms for a reflex triode and reflex tetrode indicating the reduction in imepdance collapse with the tetrode.
Figure 3B:
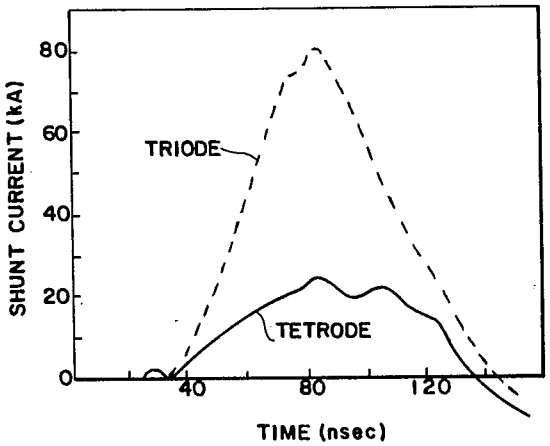

The reduction in impedance collapse achieved with the reflex tetrode is illustrated in FIG. 3*a* and FIG. 3*b* which shows the applied voltage V and total current I as a function of time for a reflex tetrode (solid lines) and a reflex triode (dashed lines). It can be seen that at about 30 nsec (FIG. 3*b* ) from the beginning of the voltage pulse, the impedance (V/I) of the reflex triode drops sharply, resulting in a voltage pulse of considerably shorter duration than is obtained with the reflex tetrode. The drop in impedance with the reflex tetrode is not nearly so severe as with the triode. Since the ions extracted from either device have an energy proportional to the anode voltage at the time they are emitted, it is possible to produce ion beams of longer duration with a reflex tetrode than with a reflex triode operated under similar conditions.

It has been determined that the efficiency of the reflex tetrode depends upon the spacing between the first and second anodes. If the distance is too small, the efficiency is decreased considerably. If the spacing distance is too great, it is possible for a virtual cathode to be formed between the two anodes and the emitted electrons from the real cathode will not reach the second anode to produce the plasma. For the voltage and anode materials and thicknesses as set forth above, the optimum spacing between the anodes is about 0.5 cm. Not only is the spacing of the anodes critical but the thickness of the anodes has a bearing on the efficiency. If the total thickness of the two anodes is too great, the number of electron transits is reduced, thereby reducing the number of protons and resulting in lower efficiency.

A range of magnetic field between 2.7 KG and 7.6 KG has relatively little effect on the operation; however, it has been determined that with no magnetic field the proton generation is greatly reduced. The proton efficiency is determined by comparing the resulting average proton current to the average value of the total current during operation.

Figure 4:
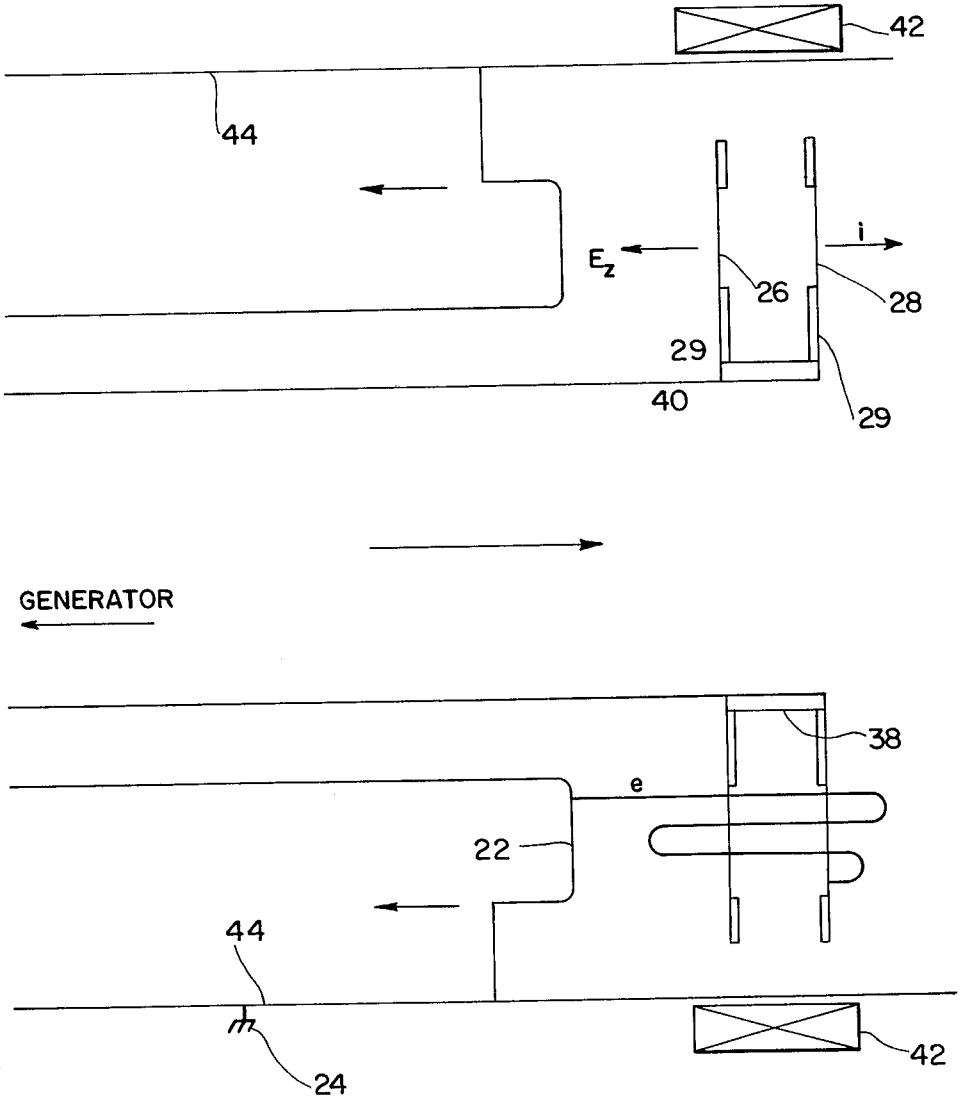
FIG. 4 is a schematic of a coaxial system.

For optimum operation, the inductance of a reflex tetrode should be low when it is powered by a low-impedance generator. FIG. 4 illustrates a modification of the structure shown in FIG. 1. FIG. 4 illustrates a low-inductance coaxial reflex tetrode. In this configuration, the high-voltage generator, and the cathode and anode structures all lie along the same axis which is the axis of the reflex tetrode. An annular graphite cathode 22 having a 52 cm inner diameter × 54 cm outer diameter, is maintained at ground potential 24. The first anode 26 is made of 6-μm-thick aluminized mylar and the second anode 28 is made of 13-μm-thick polyethylene.

Figure 5:
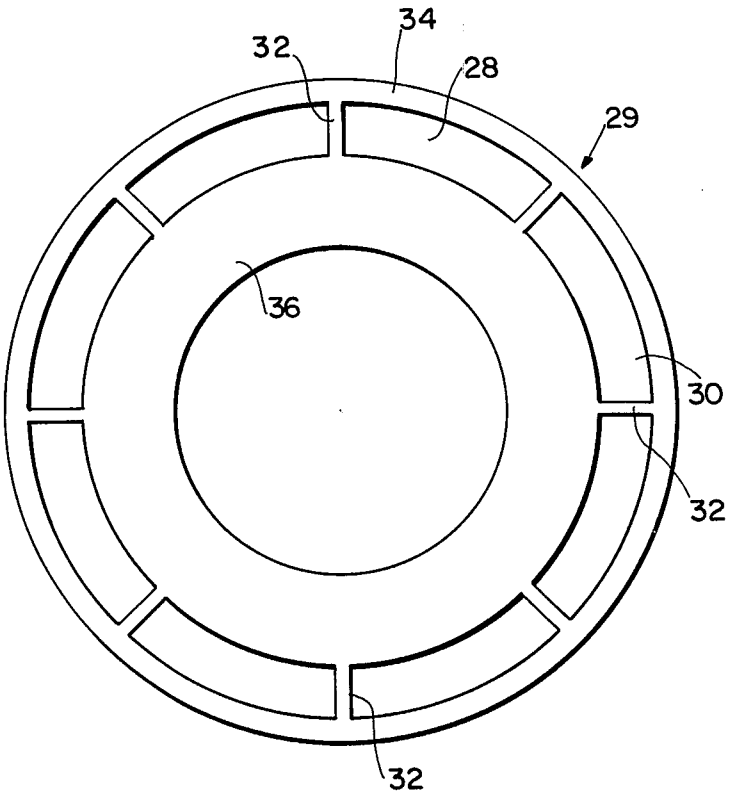
FIG. 5 illustrates an anode support.

The first and second anodes are annular to ring-like structures mounted on separate thin, flat, stainless steel annular supports 29 shown in FIG. 5. Each support is circularly slotted (30) nearer their outer edge with radial supporting ribs 32 circumferentially separating the slots and supporting the outer ring 34 formed by the slots. The ring-like anodes are secured to the surface of the outer ring 34 extend across the slots 30 and are secured to the surface of the inner ring 36. The two anode supports 29 are assembled parallel with each other and secured to opposite faces of a ring or spacer 38 which has the proper length to space the anodes at their proper spacing. The spacer 38 and anode supports 29 are mounted on and secured to the outer surface of a stainless-steel cylinder 40 which is attached. The film of each anode 28 is attached by any convenient means to the rings 34 and 36 so as to cover the slots 30 (only one anode structure is shown in in FIG. 5.)

The anode supporting 29 including rings 34 and 36 are mounted on a stainless-steel cylinder 40 which is attached to the center (high voltage) conductor of a high-voltage generator. The length of the cylinder 40 is adjustable to allow a variation of the spacing between the cathode and the first anode. An axial magnetic field is supplied by electromagnet coils 42 located outside the vacuum chamber, which encloses the device. The vacuum chamber is at ground potential so the cathode may be connected to the vacuum chamber. This device produces about 200 kA of proton current of about 1 MeV energy.

The principle of operation of the coaxial reflex tetrode is the same as that of the side-fed reflex tetrode described above and shown in FIG. 1. In use, the coaxial reflex tetrode produces a unidirectional beam with about twice the efficiency of a similar coaxial reflex triode.

In light of the present teaching, it would be obvious that different anode materials may be used with different thicknesses and spacings in order to operate at different voltage and current levels. Particularly, an alternative material for the first anode, which is less likely to flash over and produce a plasma, may result in better performance at higher power levels.

Comparison between the reflex tetrode of this invention and a reflex triode has been set forth in the following publications:

(1) *Physical Review Letters* 40, 448 (1978) entitled "Reflex Tetrode with Unidirectional Ion Flow" by J. A. Pasour et al., and

(2) *Applied Physics Letters* 32, 522 (1978) entitled "Studies of Ion Beam Generation Efficiences with Reflex Tetrode," by R. A. Mahaffey et al. The disclosed invention is also set forth in the publications, and the publications are incorporated herein by reference.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A reflex tetrode for efficiency producing unidirectionly ion beams comprising:

an evacuated chamber including therein a cathode and an anode structure;

said anode structure spaced from and in axial alignment with said cathode, said anode structure including a first anode spaced from said cathode and made of a material that is a poor source of ions, and a second anode spaced from and in parallelism with said first anode on the side thereof away from said cathode and made of a material that readily produces a plasma of ions when penetrated by electrons, said second anode being connected electrically with said first anode, and said first and second anodes being made of materials through which electrons easily penetrate so that the application of a pulse of high voltage between the cathode and anodes results in a flow of ions beyond the second anode in the cathode-to-anode direction.

2. A reflex tetrode as claimed in claim 1 in which:

said first anode is made of a thin metalized polymer sheet of polycarbonate, Kapton or titanium foil.

3. A reflex tetrode as claimed in claim 1 in which:

said first anode is made of a thin sheet of aluminized mylar.

4. A reflex tetrode as claimed in claim 1 in which:

said second anode is made of a thin sheet of polyethylene.

5. A reflex tetrode as claimed in claim 2 in which:

said second anode is made of a thin sheet of polyethylene.

6. A reflex tetrode as claimed in claim 3 in which:

said second anode is made of a thin sheet of polyethylene.

7. A reflex tetrode as claimed in claim 2 in which:

said first anode has a thickness of from 2 μm to about 4 μm.

8. A reflex tetrode as claimed in claim 3 in which:

said first anode has a thickness of from 6 μm to about 20 μm.

9. A reflex tetrode as claimed in claim 6 in which:

said second anode has a thickness of from about 6 μm to about 100 μm.

10. A reflex tetrode as claimed in claim 7 in which:

said second anode has a thickness of from about 6 μm to about 100 μm.

11. A reflex tetrode as claimed in claim 8 in which:

said second anode has a thickness of from about 6 μm to about 100 μm.

12. A reflex tetrode as claimed in claim 10, which further comprises:

means for producing a magnetic field along the cathode-anode structure axis.

13. A reflex tetrode as claimed in claim 11, which further comprises:

means for producing a magnetic field along the cathode-anode structure axis.

14. A reflex tetrode as claimed in claim 1 in which:

said cathode is a solid of graphite; and said first and second anodes are disk-like with their centers on the axis of the reflex tetrode.

15. A reflex tetrode as claimed in claim 1 in which:

said cathode is annular, said anodes are ring-like;

the central axes of said cathode and said anodes are colinear; and the anode areas transverse to the central axis are substantially coextensive with the electron-emitting area of the cathode.

* * * * *